US008117689B2

(12) United States Patent
Slayton

(10) Patent No.: US 8,117,689 B2
(45) Date of Patent: Feb. 21, 2012

(54) PORTABLE WASH BASIN CART AND DISPOSABLE PERSONAL WASH BASIN

(76) Inventor: Shamirra Slayton, Macedonia, OH (US)

( * ) Notice: Subject to any disclaimer, the term of this patent is extended or adjusted under 35 U.S.C. 154(b) by 380 days.

(21) Appl. No.: 12/264,528

(22) Filed: Nov. 4, 2008

(65) Prior Publication Data

US 2009/0113618 A1 May 7, 2009

Related U.S. Application Data

(60) Provisional application No. 60/985,770, filed on Nov. 6, 2007.

(51) Int. Cl.
*A47B 77/06* (2006.01)

(52) U.S. Cl. ..... 4/630; 4/516; 4/619; 4/553; 4/580; 4/554

(58) Field of Classification Search ..... 4/630, 554, 4/549, 553, 638, 580, 516, 619, 572.1, 572.2, 4/584

See application file for complete search history.

(56) References Cited

U.S. PATENT DOCUMENTS

| | | | | |
|---|---|---|---|---|
| 2,518,604 | A * | 8/1950 | Douglas | 4/548 |
| 4,305,165 | A * | 12/1981 | Wall, Jr. | 4/549 |
| 5,881,404 | A * | 3/1999 | Knight | 4/645 |
| 5,926,866 | A * | 7/1999 | Chao | 4/572.1 |
| 6,101,643 | A * | 8/2000 | Moore | 4/631 |
| 6,427,259 | B1 * | 8/2002 | Cawthon | 4/650 |
| 2007/0044225 | A1 * | 3/2007 | Palacios | 4/516 |

* cited by examiner

*Primary Examiner* — Gregory Huson
*Assistant Examiner* — Lauren Heitzer
(74) *Attorney, Agent, or Firm* — Zollinger & Burleson Ltd.

(57) ABSTRACT

A wheeled cart is configured to removably carry a patient's personal wash basin. The cart includes a lid that covers the personal wash basin when the cart is moved from a bathroom to the patient so that liquid in the wash basin cannot splash out onto the floor if the cart strikes an obstruction. A flexible tube is provided for filling the basin from a sink. A drain pipe is provided to empty the wash basin without the need to lift the wash basin. A disposable thin personal wash basin having a funnel-shaped outlet may be used with the cart to minimize potential contamination.

13 Claims, 11 Drawing Sheets

PORTABLE WASH BASIN CART AND DISPOSABLE PERSONAL WASH BASIN

CROSS REFERENCE TO RELATED APPLICATIONS

This application claims the benefit of U.S. Provisional Patent Application Ser. No. 60/985,770 filed Nov. 6, 2007; the disclosures of which are incorporated herein by reference.

BACKGROUND OF THE INVENTION

1. Technical Field

The present invention generally relates to health care devices and, more particularly, to a portable wash basin cart that is used to hold a patient's personal wash basin in a mobile, sanitary manner.

2. Background Information

Health care providers in a variety of environments often require a portable wash basin that is individual to the patient. Health care providers currently use a portable wash basin that must be carried back and forth from a bathroom for filling, emptying, cleaning, and refilling. Lower back pain is a common complaint of the users. These portable wash basins are typically a simple rectangular bucket that holds the wash and waste water. The wash basins are typically placed on available table, couch, or bed space when they are being used with the patient. When full of water, the basins are fairly heavy and unwieldy. Current was basins often cause spills and contamination to the support surface as well as surrounding areas.

BRIEF SUMMARY OF THE INVENTION

The invention provides a wheeled cart configured to removably carry a patient's personal wash basin in a sanitary manner. The cart also allows the personal wash basin to be emptied and cleaned in a sanitary manner. The cart also allows the personal wash basin to be filled and moved without straining the back muscles of the user. The invention also provides a disposable personal wash basin for use with the cart.

The invention also provides a personal wash basin having a funnel-shaped outlet that protrudes from the lower surface of the personal wash basin. The funnel-shaped outlet may cooperate with a funnel-shaped outlet of the cart to minimize contact between the cart and contaminated waste water. The personal wash basin may be made from a thin, flexible material, such as a plastic, that may be disposable or recyclable.

In one configuration, the invention provides a portable wash basin cart for health care providers; the portable wash basin cart including: a frame; a personal wash basin defining an outlet; the personal wash basin being carried by the frame; a funnel carried by the frame; the outlet of the personal wash basin being aligned with the funnel; and a flexible drain pipe connected to the funnel.

Another configuration of the invention provides a portable personal wash basin cart that includes: a wheeled frame; a base basin carried by the wheeled frame; the base basin having a bottom wall defining an outlet; and a personal wash basin removably carried by the base basin; the personal wash basin having a bottom wall defining an outlet; the outlets being aligned when the personal wash basin carried by the base basin.

Each of the configurations described above may include flexible tube that allows water from a sink to be directed into the personal wash basin. Each of the configurations described above may include a frame that includes a handle with a lid for the personal wash basin connected to the handle.

A further configuration of the invention provides a portable personal wash basin cart that includes includes a base basin that is fixed to a cart frame and adapted to receive the patient's personal wash basin. The two basins may interlock at outlet funnels so that the personal wash basin is stable when held by the base basin. The outlet funnels allow the patient's personal wash basin to be drained without removing it from the base basin. The funnel-shaped opening prevents fluid from the personal basin from fouling the bottom of the base basin. A flexible drain pipe is removably connected to the outlet of the funnel-shaped opening. The drain pipe has an outlet adapted to fit onto a toilet bowl so the personal basin may be emptied directly into a toilet. To facilitate such draining, the outlet end of the drain pipe may be held by a C-shaped bracket that fits over the edge of a toilet bowl and holds the outlet end of the pipe in place. Caps are connected to both ends of the drain pipe and to the funnel-shaped opening to selectively close the openings. The cap for the funnel-shaped opening is used when the drain pipe is detached for cleaning. The cart includes a hook to hold the outlet end of the drain pipe so that the outlet is raised when not in use to limit dripping.

Another configuration of the invention provides a cart with a pair of basin holders. The dual configuration has the capacity to accommodate twice the amount of water/waste while providing the same sanitary benefits as the single unit.

The different features of the configurations described above may be combined in different combinations to form additional configurations. Each of the configurations described above may be provided with telescoping legs to allow the user to adjust the height of the device.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
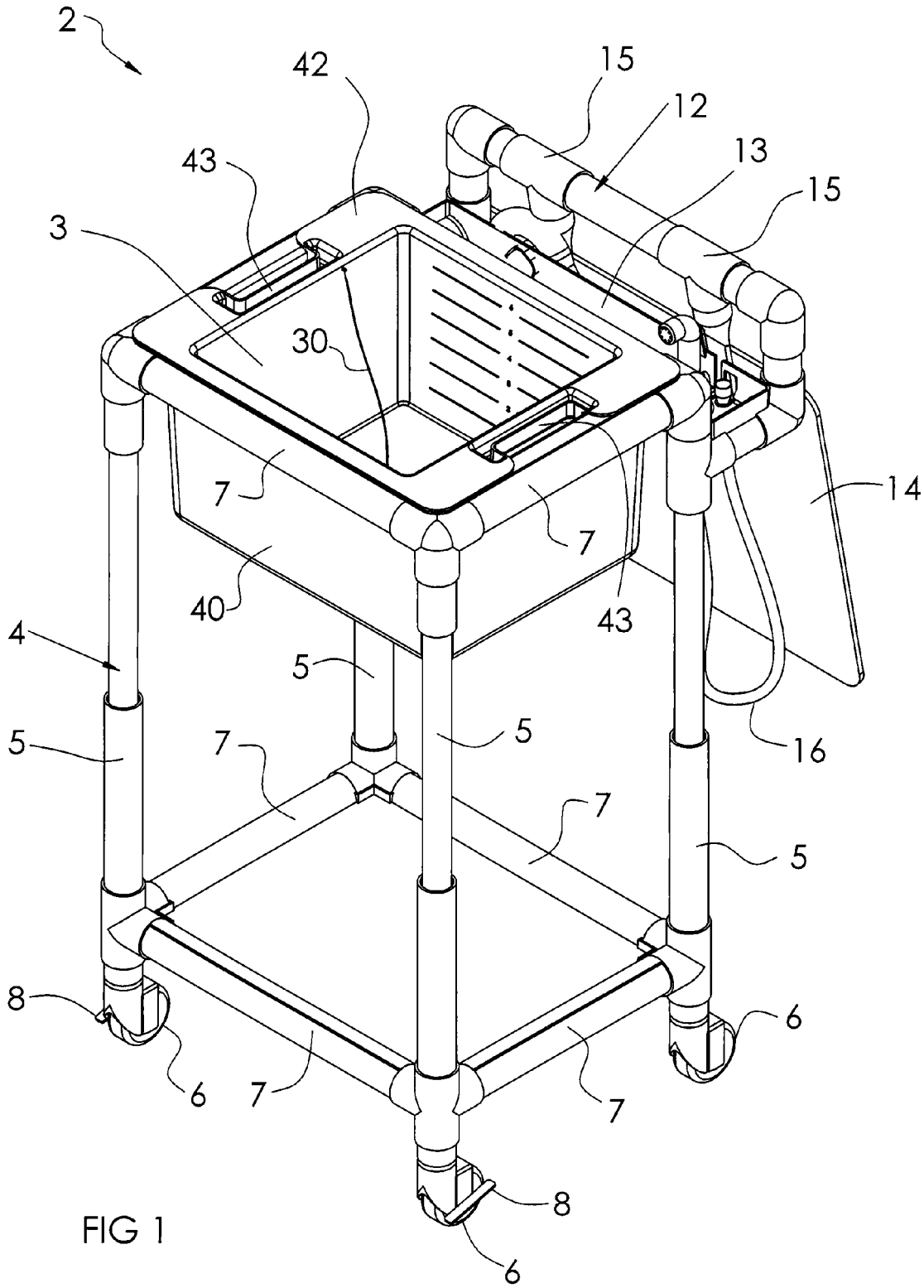
FIG. 1 is a front perspective view of an exemplary configuration of a portable wash basin cart.
Figure 2:
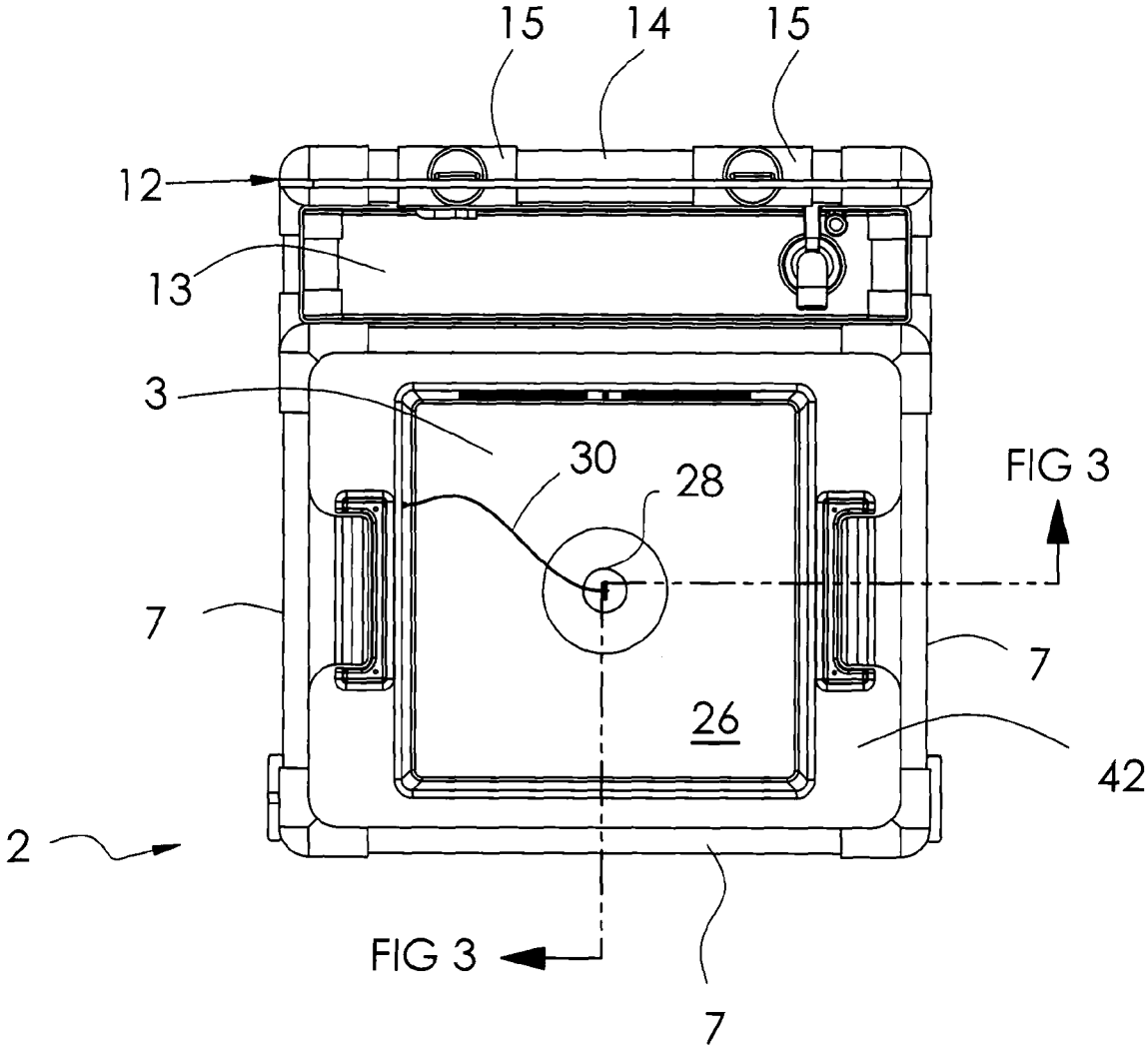
FIG. 2 is a top plan view of the cart of FIG. 1 with the lid in a different position.

The portable wash basin cart of the invention is indicated generally by the numeral 2 in the accompanying drawings. Portable wash basin cart 2 allows a personal wash basin 3 filled with waste water to be safely moved from one location to another with little risk that the waste water will spill out of cart 2 to contaminate an area that must then be cleaned. Personal wash basin 3 may be in the form of a stand-alone wash basin that is relatively rigid and capable of standing up while full of water. In another configuration, personal wash basin 3 may be provided in the form of a thin, flexible polymeric liner. The thin liner version of personal wash basin 3 may be disposable or recyclable. Portable wash basin cart 2 includes a flexible drain pipe that allows the user to safely drain waste water from personal wash basin 3 without strain on the user's back and with little risk of spilling the waste water during the draining process.

Cart 2 includes a frame 4 that is supported by at least two wheels 6. Frame 4 may include four vertical legs 5 connected together with upper and lower sets of arms 7 disposed perpendicular to legs 5. Legs 5 may be in the form of telescoping members to allow the height of cart 2 to be readily adjusted. The telescoping members may be held with friction or a ratchet that allows the user to adjust all four legs simply by lifting up or pushing down on was basin 3. A common release catch also may be used to permit the adjustments. Each wheel 6 may be selectively locked with a brake 8. Brakes 8 may be a lever-type or friction-type that prevent the wheel from freely rotating. When only two wheels 6 are used on cart 2, one end of cart 2 must be lifted to roll cart 2 along the ground. Three or four wheels 6 are typically used so that cart 2 may be readily rolled from place to place without lifting a portion of frame 4. Frame 4 may be fabricated from any of a variety of materials such as metal, plastic, or wood. In one exemplary configuration, frame 4 is fabricated from plastic or PVC tubes that are relatively light-weight and easy to sanitize. When plastic or PVC tubes are used to form frame 4, corner joints and adhesive may be used to connect arms 7 with legs 5. Mechanical connectors, such as screws, bolts, or rivets, may be used to secure the joints.

Frame 4 may be configured to define a storage shelf 10, a plurality of shelves 10, or a basket 10 that is adapted to hold supplies. Shelf 10 may be disposed just below a set of arms 7 to define a recessed shelf 10 with arms 7 defining a lip disposed about the perimeter of shelf 10.

Figure 11:
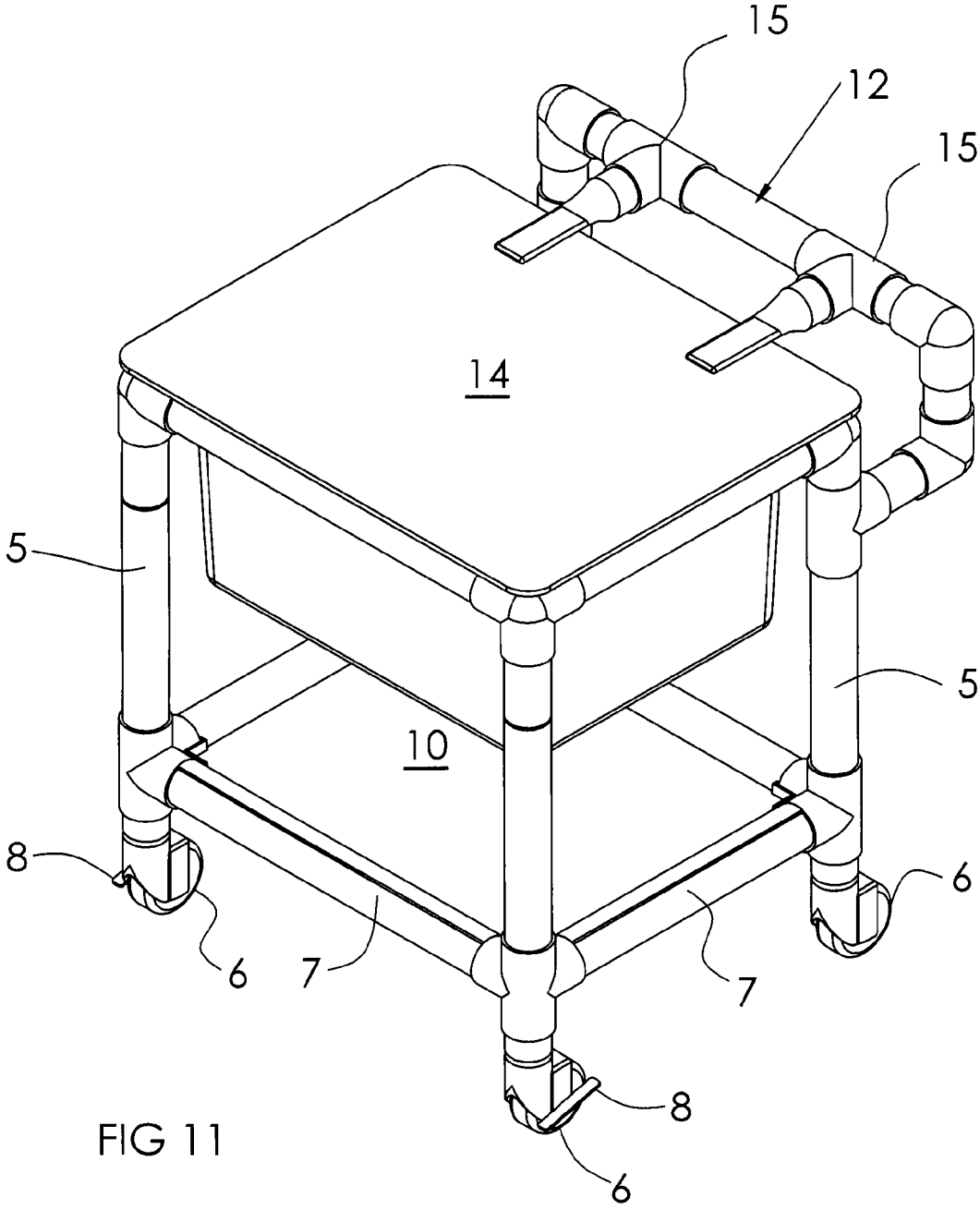
FIG. 11 is a perspective view of the portable wash basin cart with the lid closed.

Frame 4 also may define a handle 12 that allows the user to grip cart 2 and control the movement of cart 2. A lid 14 configured to cover wash basin 3 may be carried by handle 12 in a manner that allows lid 14 to be moved between open and closed positions. A pair of legs 15 connect lid 14 to handle 12. Each leg 15 may include a sleeve that is rotatably carried by handle 12 to allow lid 14 to rotate between different positions. Handle 12 has an elongated, substantially horizontal portion that extends across the width of basin 2 where legs 15 are connected. Handle 12 includes a pair of L-shaped ends that have vertical portions that drop down from the ends of the elongated, horizontal portion and horizontal offset portions that connect to frame 4. The offset portions provide space for a tray or shelf 13 disposed intermediate basin 3 and handle 12. Tray 13 may be removably carried on the horizontal offset portions of the L-shaped ends of handle 12. When completely open, lid 14 may hang down from frame 4 so that it will not accidentally fall down over the top of the wash basin on the user's hands or arms. The closed position of lid 14 (FIG. 11) is used to cover personal wash basin 3 to prevent accidental splashes when cart 2 is being moved from place to place.

A flexible tube 16 may be used to fill personal wash basin 3 from a sink. Flexible tube 16 includes a faucet adapter 18 that fits a variety of common kitchen or bathroom sink faucets so that person wash basin 3 may be filled with clean water from a variety of locations. Tube 16 also prevents the user from having to lift a full wash basin 3 from a sink to cart 2. Tube 16 may have a spray attachment on the cart end of tube 16. Tube 16 may pass through an opening in tray 13 that functions to hold the spray attachment when tube 16 is not in use.

Portable wash basin cart 2 is configured to hold personal wash basin 3 that is typically filled with water or a water/soap combination used to attend to a patient. Basin 3 is personal to the patient and thus must be removed from cart 2 if cart 2 is used with a different patient. As such, basin 3 is removably carried by frame 4.

Basin 3 is typically plastic and may be any of a variety of shapes such as round, oval, square, rectangular, or the like. A typical rectangular wash basin 3 is depicted as an example in the drawings. Basin 3 may be provided with its own lid that is snapped over the upper lip of basin 3 so that basin 3 may be sealed closed when removed from cart 2.

Figure 3:
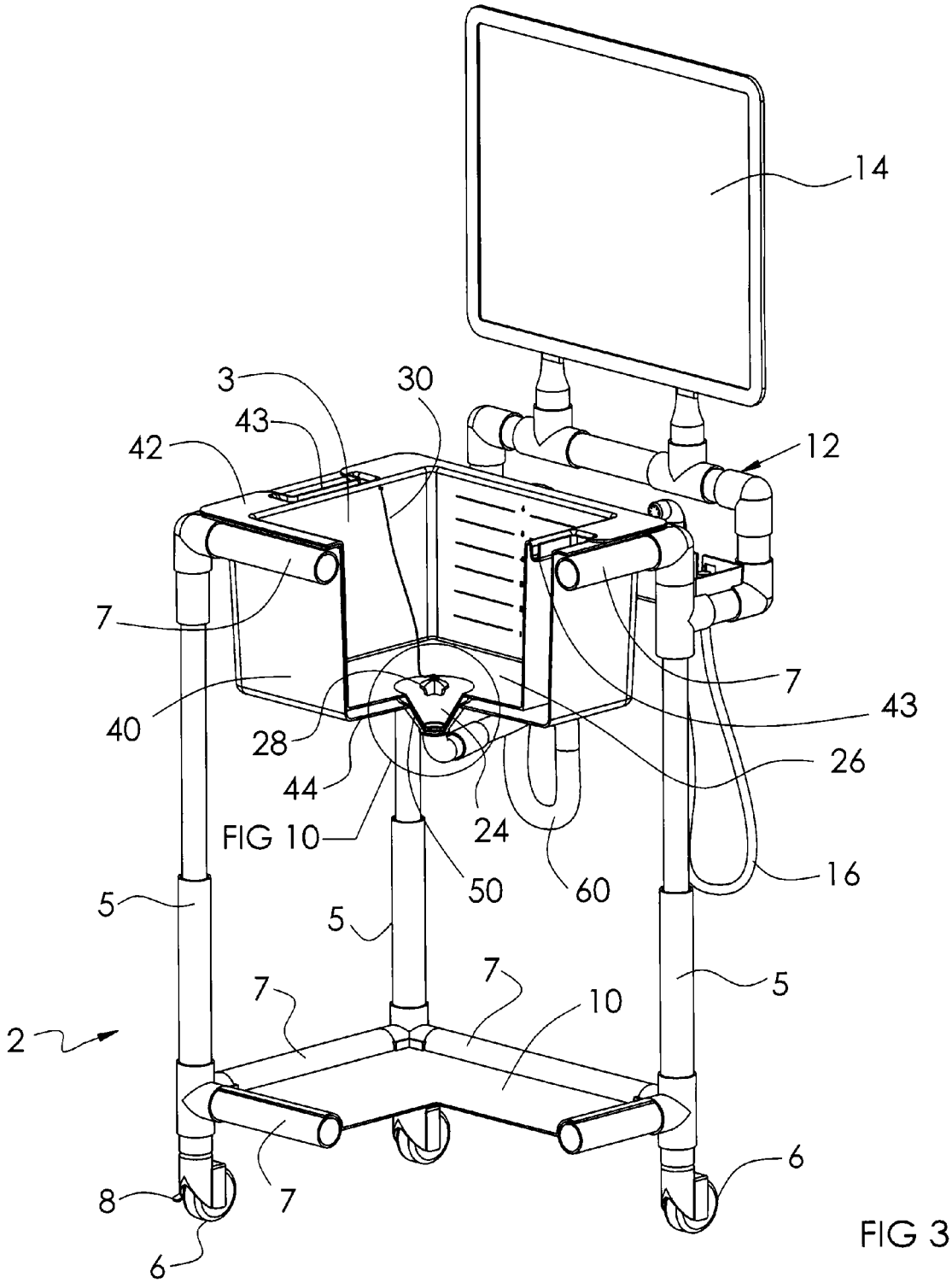
FIG. 3 is a perspective view, partially in section, taken along line 3-3 of FIG. 2.
Figure 4:
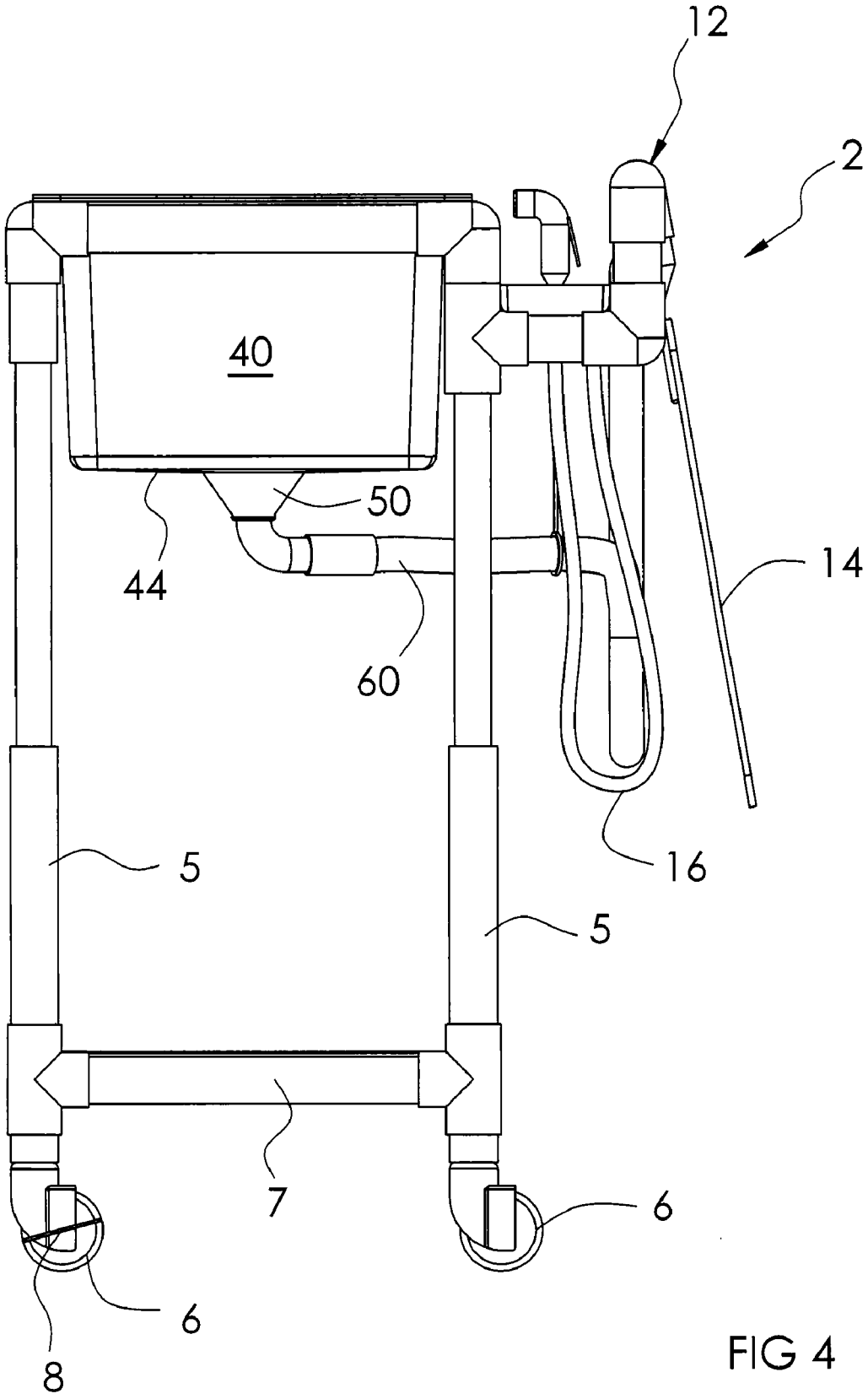
FIG. 4 is a side elevation view of the portable wash basin cart of FIG. 1.
Figure 10:
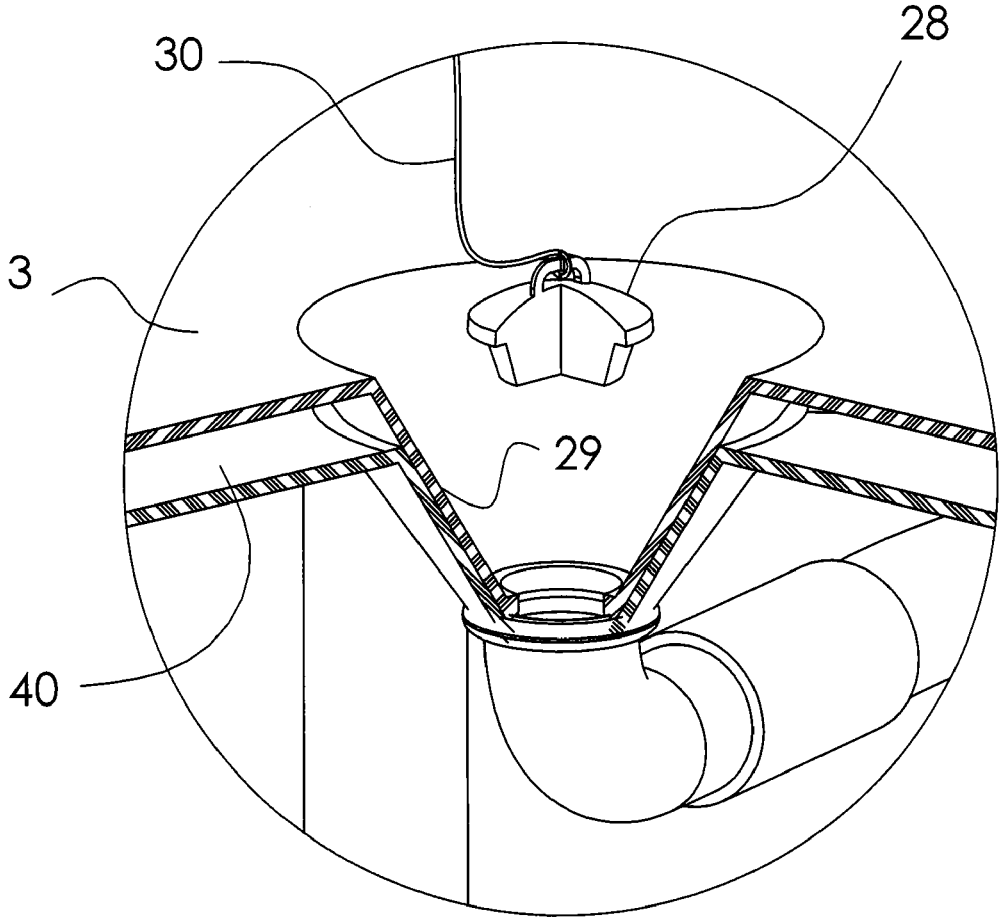
FIG. 10 is an enlarged perspective view of the encircled portion of FIG. 3.

Basin 3 may be provided with a drain opening 24 defined by the bottom wall 26 of basin 3. A plug 28 is used to seal opening 24 when basin 3 is in use. Plug 28 may be secured to the top edge of basin 3 with a pull chain 30 to allow the user to pull plug 28 without reaching into the waste water in basin 3. In one configuration of the invention, drain opening 24 is defined by a wall 29 that protrudes downwardly from bottom wall 26. The protruding wall 29 may be shaped in the form of a funnel as shown in FIGS. 3 and 10.

In one configuration of the invention, frame 4 is configured to removably receive basin 3 directly. In the exemplary configuration of the invention depicted in the drawings, frame 4 includes a base basin 40 sized to removably receive personal wash basin 3. In either example, a personal wash basin with or without funnel 29 may be removably held by frame 4.

Wash basin 3 includes an upper flange 42 that rests on top of the upper lip of base basin 40. Upper flange 42 of wash basin 3 defines a pair of handles 43 that allow basin 3 to be lifted from basin 40. Flange 42 defines an opening adjacent each handle 43 so that the user may insert her hand between handle 43 and frame 4 when lifting basin 3. Each handle 43 is C-shaped when viewed from above. Each handle 43 is integrally formed with flange 42. Each handle 43 includes a rounded bottom wall that is spaced from the basin wall of basin 3 as shown in FIG. 3 so that the user's fingers may be slipped between handle 43 and the basin wall when basin 3 is being lifted. As shown in FIG. 3, each handle 43 is disposed within base basin 40 when personal wash basin 3 is carried by frame 4. This position ensures that any water splashing from basin 3 into the handle holes will be directed into base basin 40 and not onto the patient's floor.

Base basin 40 has a bottom wall 44 that includes a funnel 50 configured to receive funnel 29 so that personal wash basin 3 is supported from below by the contact between funnel 29 and funnel 50. Funnel 50 defines the drain opening of basin 40 and allows basin 3 to be emptied without removing it from cart 2. Funnel 50 is positioned directly below opening 24 so that little, if any, waste water draining from basin 3 will contact the inner surface of bottom wall 44. Funnel 50 may be integrally formed with basin 40 or may be connected in an appropriate manner such as a press fit. Funnel 50 may have a larger diameter opening than opening 24. An elbow joint may be connected to funnel 50 to direct waste water rearwardly. A removable cap may be provided to seal funnel 50 or the elbow joint when a drain pipe 60 is removed. As shown in FIG. 10, funnel 50 is configured to position the outlet of funnel 29 substantially evenly with the outlet of funnel 50 to minimize contact between waste water being drained from basin 3 and base basin 40. Funnels 29 and 50 may be configured to position bottom wall 26 spaced from bottom wall 44 so that basin 3 may be easily removed from base basin 40.

Figure 5:
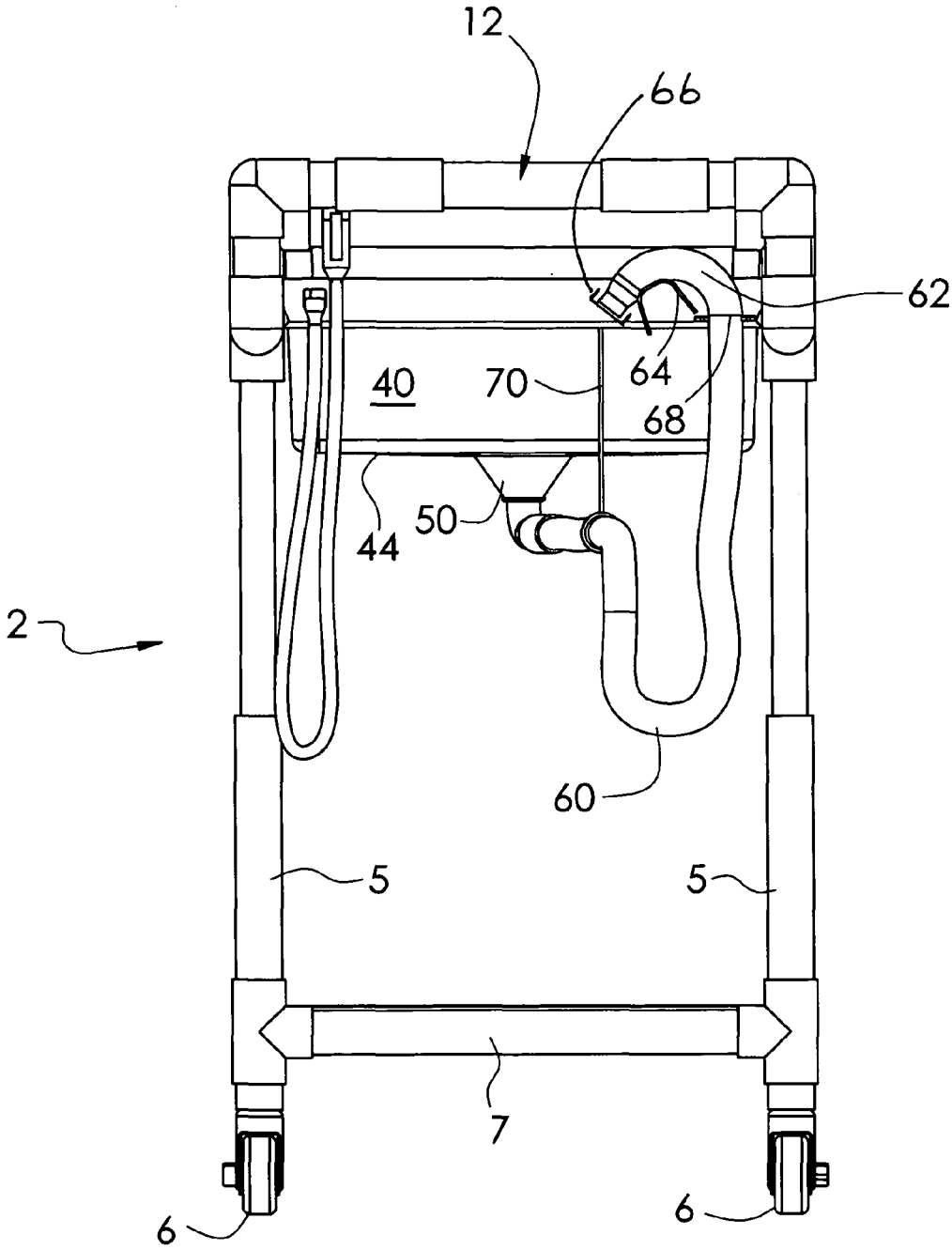
FIG. 5 is a rear elevation view of the portable wash basin cart of FIG. 1 with the lid closed.
Figure 6:
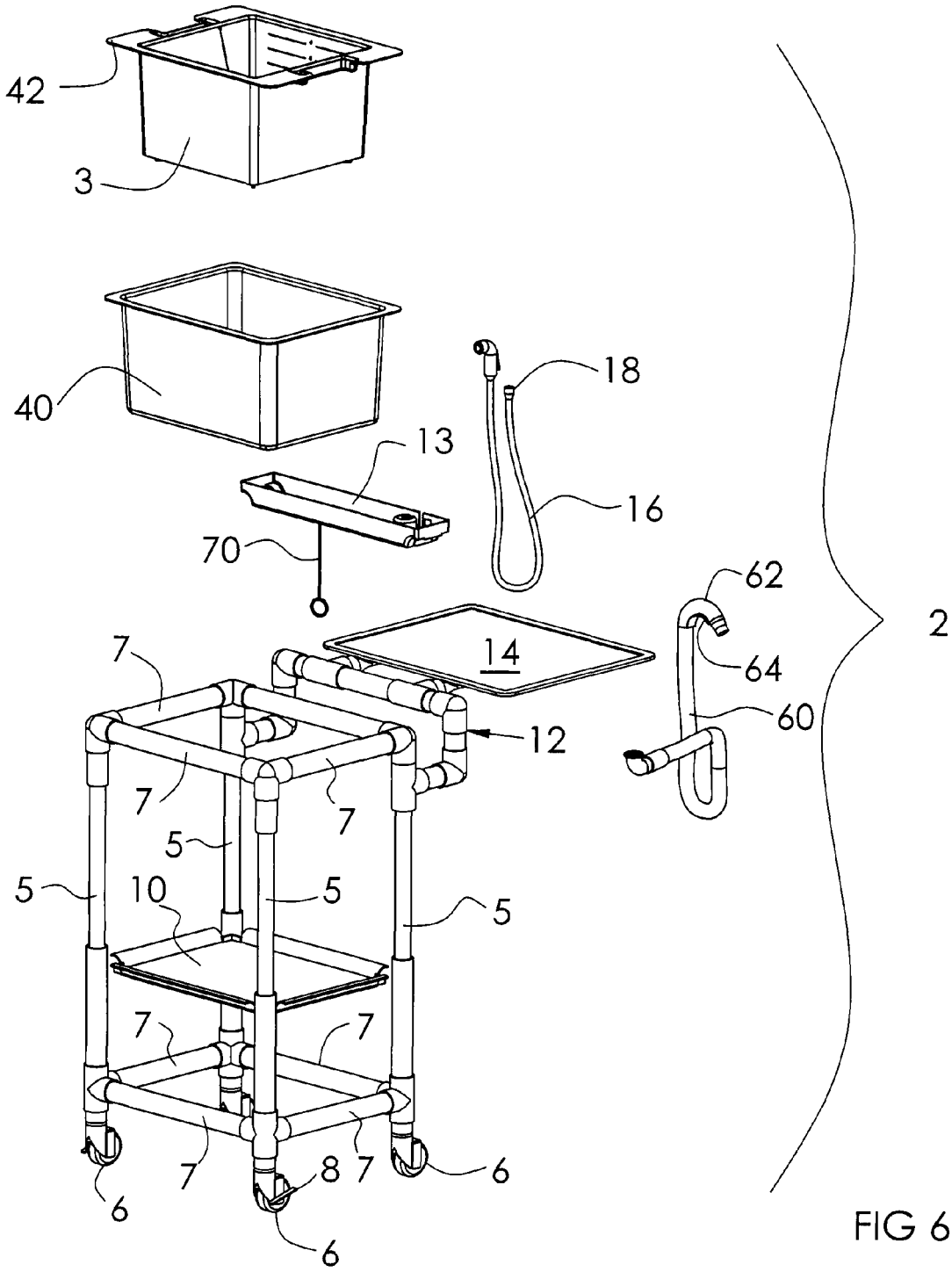
FIG. 6 is an exploded perspective view of the portable wash basin cart of FIG. 1.
Figure 7:
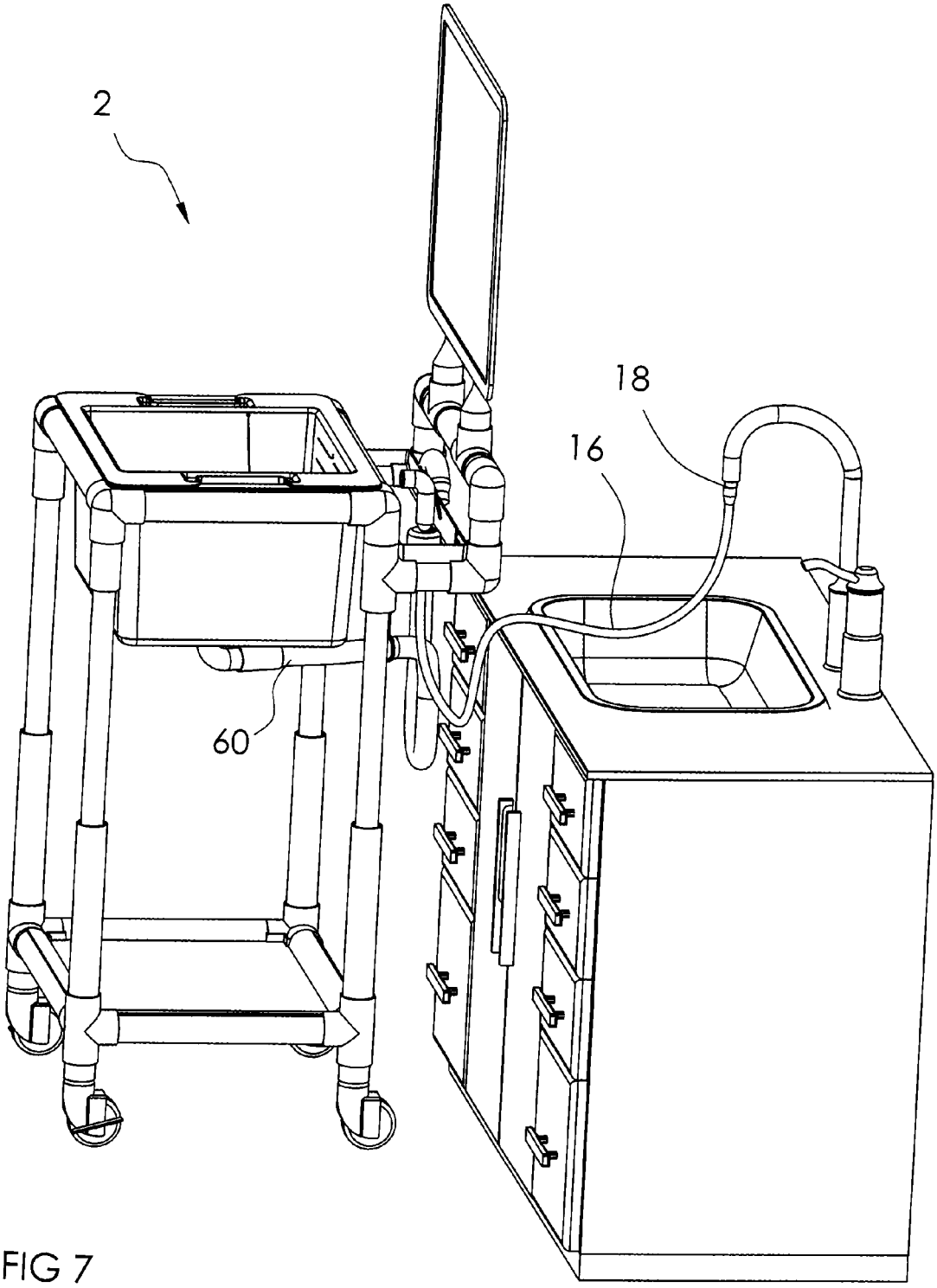
FIG. 7 is a perspective view of the portable wash basin cart of FIG. 1 attached to a sink faucet.
Figure 8:
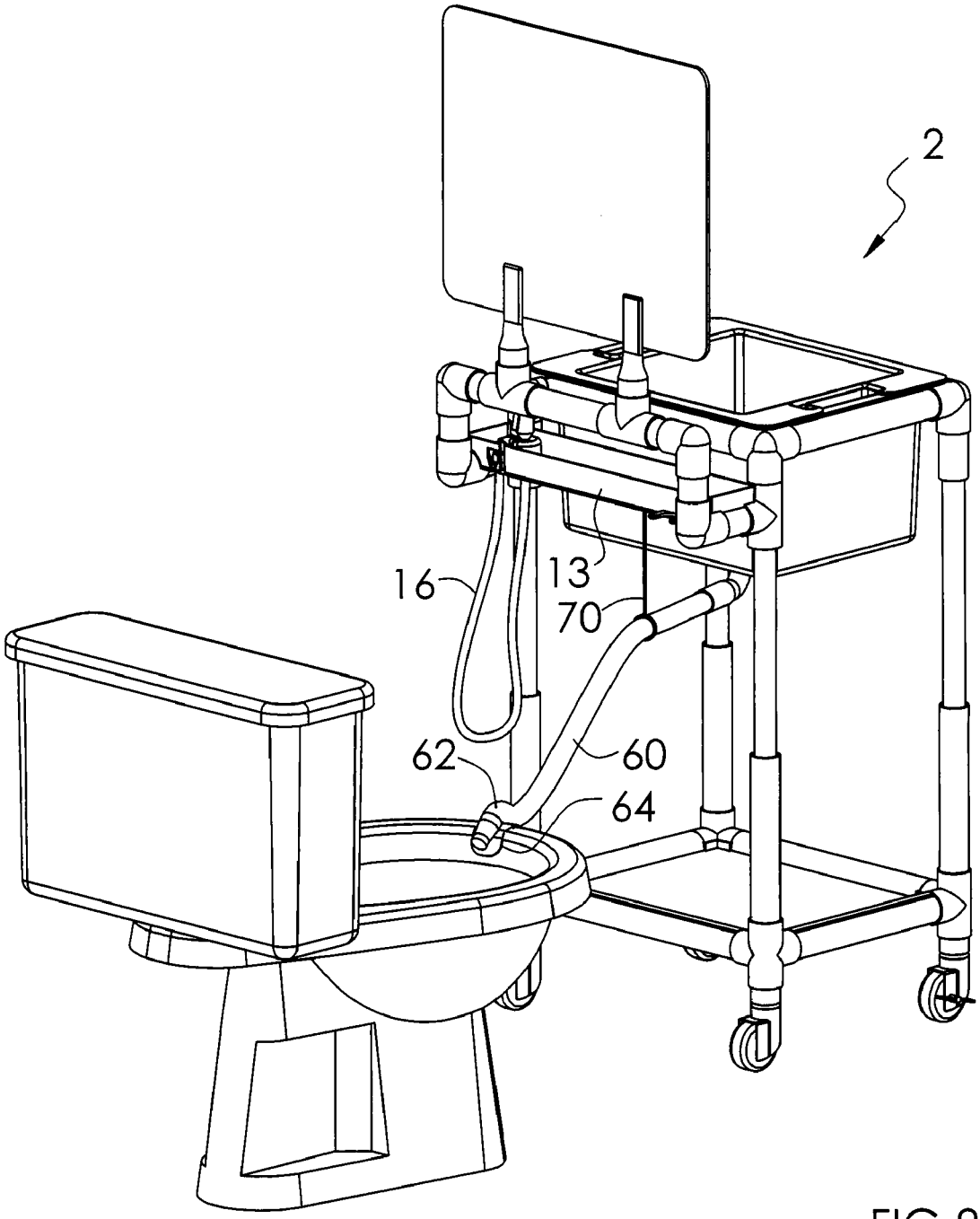
FIG. 8 is a perspective view of the portable wash basin cart of FIG. 1 emptying waste water into a toilet.
Figure 9:
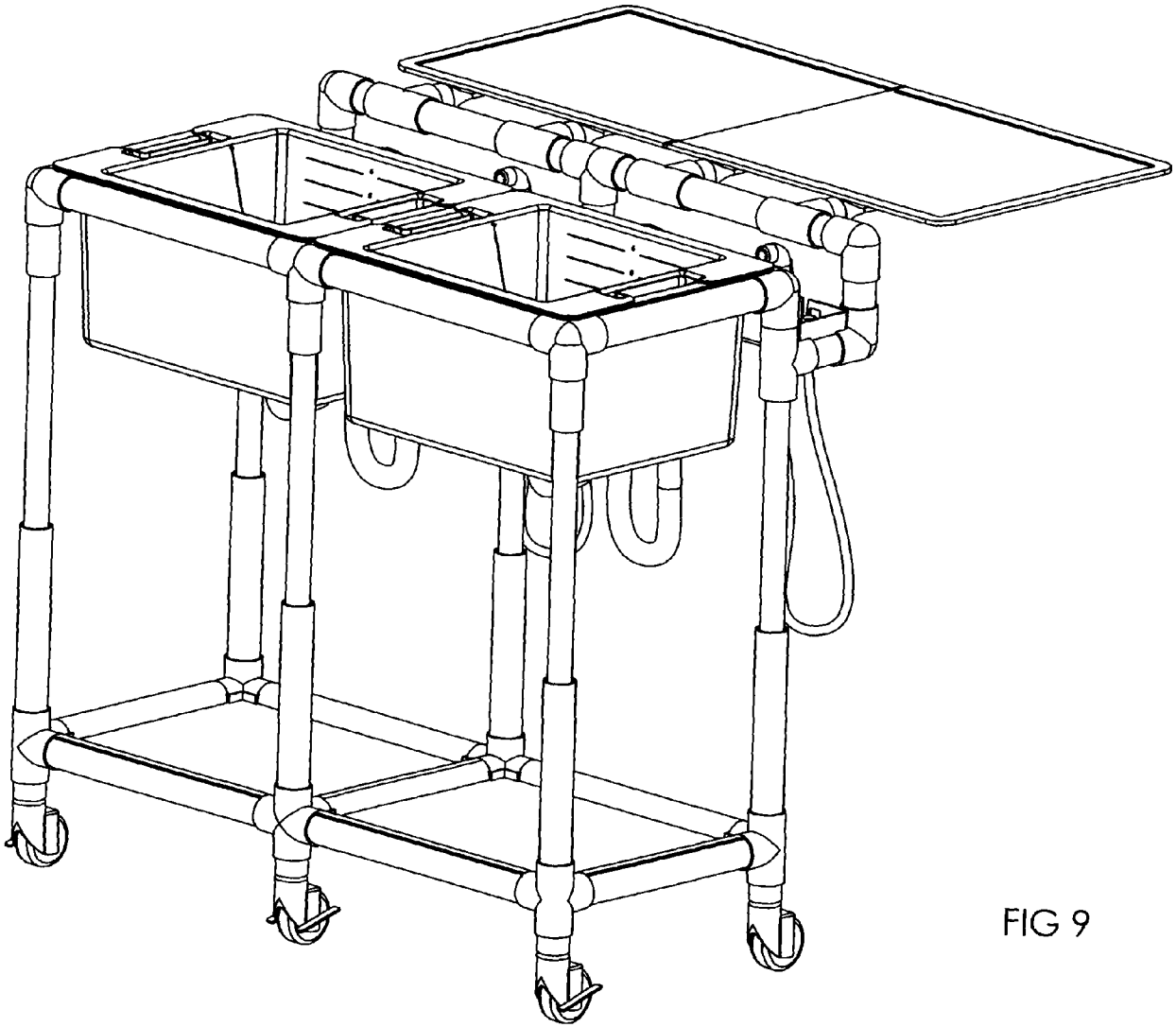
FIG. 9 is a perspective view of an exemplary double basin cart with the lids in their open positions.

Flexible drain pipe 60 is removably connectable to the outlet of funnel 50. Drain pipe 60 has an outlet 62 adapted to fit onto the edge of a toilet bowl so personal basin 3 may be emptied directly into a toilet. To facilitate such draining, outlet 62 of drain pipe 60 may be held by a C-shaped bracket 64 that fits over the edge of a toilet bowl and holds outlet 62 of pipe 60 in place. As shown in FIG. 5, the legs of the C-shaped bracket diverge so that the bracket may be used with a variety of different bowl rims. Caps may be removably connectable to both ends of drain pipe 60 to selectively close its openings. The caps are used when drain pipe 60 is detached from funnel 50. Frame 4 includes a hook 68 to hold outlet 62 of drain pipe 60 so that outlet 62 is raised when not in use to limit dripping. A support 70 may hang from tray 13 to support pipe 60.

Another configuration of the invention provides cart 2 that removably receives a pair of personal wash basins 3. The dual configuration has the capacity to accommodate twice the amount of the water or waste water while providing the same sanitary benefits as the single unit 2.

Cart 2 may be used by fitting basin 3 into frame 4 and fitting plug 28 into opening 24. Cart 2 is then moved adjacent a water source wherein tube 16 is used to fill basin 3 with water. Lid 14 may then be closed and cart 2 is wheeled to a position adjacent the patient. The user opens lid 14 and performs the care needed by the patient. When cart 2 has a double basin, one basin may be used for clean water while the other is used for waste water. Once the user is ready is empty the waste water from basin 3, the user may close lid 14 and move cart 2 into a bathroom. The user checks the connection between drain pipe 60 and funnel 50, clips outlet end 62 to the edge of a toilet, and removes cap 66. The user then pulls chain 30 to remove plug 28 and the water drains directly into the toilet. Cart 2 thus prevents the patient's sink from being fouled with waste water. The user may then clean personal basin 3 by connecting tube 16 to a sink and washing basin 3 while basin 3 remains in cart 2. Cleaning basin 3 in this manner further prevents contamination of the patient's sink. Basin 3 may then be removed from cart 2 and left with the patient. Cart 2 is reused with the next patient by inserting the next patient's personal basin into frame 4 and repeating the process.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A portable wash basin cart for health care providers;

the portable wash basin cart comprising:

a frame;

a base basin carried by the frame; the base basin having a bottom wall and an outlet funnel extending down from the bottom wall of the base basin;

a personal wash basin defining an outlet; the personal wash basin being removably disposed within the base basin; the personal wash basin being a self-supporting basin having side and bottom walls; the bottom wall of the personal wash basin defining the outlet of the personal wash basin; the personal wash basin maintaining the shape of its side and bottom walls when separated from the base basin;

the outlet of the personal wash basin being aligned with the outlet funnel; and a flexible drain pipe connected to the outlet funnel.

2. The cart of claim 1, further comprising a lid carried by the frame;

the lid being movable between open and closed positions; the closed position of the lid covering the personal wash basin.

3. The cart of claim 1, further comprising a plug for the outlet of the personal wash basin.

4. The cart of claim 1, wherein the personal wash basin is removably carried by the base basin.

5. The cart of claim 4, wherein the personal wash basin includes a funnel that defines the outlet to the personal wash basin; at least a portion of the funnel of the personal wash basin being disposed in the funnel of the base basin when the personal wash basin is received in the base basin.

6. The cart of claim 5, wherein the funnel of the personal wash basin rests directly on the funnel of the base basin to position the bottom wall of the personal wash basin above the bottom wall of the base basin such that the weight of the liquid in the personal wash basin forces the funnels together.

7. The cart of claim 1, further comprising a flexible tube having a faucet adapter disposed at one end of the flexible tube; the faucet adapter adapted to fit on a faucet to direct water into the flexible tube; and the flexible tube adapted to direct water into the personal wash basin from the faucet.

8. The cart of claim 1, further comprising a second personal wash basin carried by the frame and a second drain pipe for the second wash basin.

9. The cart of claim 1, further comprising at least two wheels connected to the frame.

10. The cart of claim 1, wherein the personal wash basin includes an upper flange that defines a pair of handles; the handles being disposed within the base basin when the personal wash basin is carried by the base basin.

11. The cart of claim 1, wherein the frame includes a handle; the lid being carried by the handle.

12. The cart of claim 11, further comprising a shelf carried by the handle.

13. The cart of claim 1, wherein the height of the cart is adjustable.

* * * * *